US008117777B2

(12) United States Patent
Chadwick

(10) Patent No.: US 8,117,777 B2
(45) Date of Patent: Feb. 21, 2012

(54) MULTI-LAYER WRISTBAND WITH REMOVABLE LABELS INCORPORATED INTO THE WRISTBAND

(75) Inventor: Robert Chadwick, Haverhill, MA (US)

(73) Assignee: Endur ID, Inc., Hampton, NH (US)

( * ) Notice: Subject to any disclaimer, the term of this patent is extended or adjusted under 35 U.S.C. 154(b) by 48 days.

(21) Appl. No.: 12/766,451

(22) Filed: Apr. 23, 2010

(65) Prior Publication Data

US 2011/0000113 A1 Jan. 6, 2011

Related U.S. Application Data

(63) Continuation-in-part of application No. 10/857,214, filed on May 28, 2004.

(60) Provisional application No. 61/171,983, filed on Apr. 23, 2009.

(51) Int. Cl.
*A44C 5/00* (2006.01)

(52) U.S. Cl. ..... 40/633

(58) Field of Classification Search ..... 40/633
See application file for complete search history.

(56) References Cited

U.S. PATENT DOCUMENTS 5,653,472 A * 8/1997 Huddleston et al. ..... 283/75
5,799,426 A * 9/1998 Peterson ..... 40/633
5,933,993 A 8/1999 Riley
5,979,941 A 11/1999 Mosher
6,000,160 A 12/1999 Riley
6,067,739 A 5/2000 Riley
6,349,493 B1 * 2/2002 Newman et al. ..... 40/633
6,438,881 B1 8/2002 Riley
6,641,048 B1 * 11/2003 Schintz et al. ..... 235/487
6,782,648 B1 8/2004 Mosher
2005/0279001 A1 * 12/2005 Riley ..... 40/633
2007/0028495 A1 * 2/2007 Kotik et al. ..... 40/633
2007/0157498 A1 * 7/2007 Ali et al. ..... 40/633

OTHER PUBLICATIONS

Laser Band. "LB2-PED: Small Wristband Assembly Instructions", HTTP://www.laserband.com/LB2-PED-small.htm.

* cited by examiner

*Primary Examiner* — Gary Hoge
(74) *Attorney, Agent, or Firm* — Onello & Mello, LLP

(57) ABSTRACT

A bracelet that has two layers, one forming the outside of the bracelet and the other forming the inside of the bracelet. The layers have different properties. The bracelet has a head end and a tail. The layers are bonded to each other and there is at least a first portion of the band at the head end in which the first layer is bonded to the second layer by means of a contact adhesive and in which the second layer is a release liner with regard to the contact adhesive. The bracelet is formable into a loop by removing the second layer from the first layer in the first portion and attaching the exposed contact adhesive to the first layer in the tail. Also disclosed is a business form which contains a band that can be formed into the bracelet.

14 Claims, 9 Drawing Sheets

MULTI-LAYER WRISTBAND WITH REMOVABLE LABELS INCORPORATED INTO THE WRISTBAND

CROSS-REFERENCE TO RELATED APPLICATIONS

The present patent application is a continuation-in-part of U.S. Ser. No. 10/857,214, Chadwick, et al., Identification bracelet, filed 28 May 2004 and claiming priority from provisional patent application 60/474,189, filed 29 May 2003. U.S. Ser. No. 10/857,214 is hereby incorporated by reference into the present application for all permissible purposes. The present patent application also claims priority from U.S. provisional patent application No. 61/171,983 Robert Chadwick, Wristband with removable labels incorporated into the wristband, filed 23 Apr., 2009. The entire provisional patent application is also hereby incorporated herein by reference for all permissible purposes. The Detailed Description of the present application contains the entire Detailed Description and Drawing of U.S. Ser. No. 10/857,214; the new material begins with the section entitled Two-layered bracelets and includes FIGS. 8 and 9.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates generally to identification bracelets and more particularly to temporary identification bracelets for use in environments in which the bracelets are applied by people other than the wearer and are exposed to moisture and common solvents.

3. Description of Related Art

Identification bracelets are used in many situations where subjects require short-term identification. Examples of the use of identification bracelets include identification of participants at meetings, of guests in a resort, of passengers in transportation, and particularly patients in hospitals or other institutions. In the hospital setting, proper identification is particularly important: it prevents patients from receiving the wrong medication or medical procedure and it allows hospital administration to track the usage of hospital facilities by a patient for billing purposes.

The hospital environment places extraordinary demands on identification bracelets:

- They need to be produced where they are used, namely at the nurses' stations;
- They often need to carry photographs and barcodes, both of which require high resolution to be useful;
- Both the bracelet and whatever is written or printed on it must be resistant to water and other common solvents;
- The bracelet must be comfortable for the patient to wear;
- The bracelet must be sanitary;
- In many situations, the bracelet must be strong enough to withstand deliberate attempts by its wearer to remove it; and
- The bracelet must be easy for the hospital personnel to make and apply.

Two main types of identification bracelets are presently used in hospitals and related institutions. The first type are bracelets that use paper protected by a plastic sleeves or an adhesive plastic film to make a band that is as printable as paper but has greater tear resistance and resistance to environmental degradation. An example of prior art of this type can be found in U.S. Pat. No. 6,510,634 to Riley, which discloses a multiple computer generated multi-web moisture proof identification bracelet. The Riley patent discloses an adhesive backed transparent film layer to encapsulate the paper strip. Problems with the first type of bracelet include the following:

- Film sleeves and adhesive backed films are difficult for hospital staff to handle. The strip of paper must first be printed or written upon. The strip is then inserted into the film sleeve, the sleeve is looped around the patient's wrist or ankle, and the ends of the bracelet are attached using a metal or plastic clasp or adhesive on the sleeve. When an adhesive backed laminate is used, the printed strip of material is placed on the adhesive backed film and the film is folded over the strip of material to encase the printed strip. A bracelet can then be formed in the same manner described above. Alternatively, the bracelet is first fitted to the patient and then encapsulated with the adhesive backed film.
- The plastic sleeve or laminate is often not tight enough to protect any paper or print within from being destroyed when the bracelet is immersed in water.
- Barcode readers can have difficulty reading barcodes through the film sleeve or laminate. The Riley patent solves this problem with a die cut window in the laminate for the barcode. The drawback of this feature is that the barcode is exposed to the environment and can therefore easily be destroyed.
- Where the bracelets have barcodes, the paper must be printed with laser printers. "Wicking" of the water-based inks used in ink jet printers makes the barcodes unreadable.

The second type of identification bracelets are those made using a printable plastic strip. An example of this type of identification bracelet can be found in U.S. Pat. No. 6,641,048 to Schintz et al., which discloses a bracelet made of a strip of polyesterplastic. The strip is printable by a standard office laser printer. The strip has adhesive at both ends of its inner side and is made into a bracelet that fits closely to the patient's wrist or ankle as shown in FIG. 1: To form the bracelet from the strip of plastic 100, the end with the first adhesive attachment point 101 must be looped and pressed against the inner surface of the strip 103, creating an adhesive bond. The second adhesive contact point 102 is then looped over and pressed against the outer surface of the strip opposite 104. Problems with the second type of bracelet include:

- The plastic strip must be printed by a laser printer and consequently cannot have a thickness beyond what a laser printer will accept. The Schintz patent discloses a 0.002 inch thick polyester film. A film of this thickness can be easily torn, either by accident or deliberately by its wearer, and can thus be easily removed by its wearer or lost. Stretching can further make the barcodes and other information unreadable.
- The thin plastic used for the bracelet is also hard for hospital staff to handle, as can be seen from the foregoing description of how the Schintz band is applied. Moreover, the loop-back technique creates a space in the band where moisture or micro organisms can gather.

None of the bracelets presently being used has a good mechanism for making a close-fitting bracelet. Attachment mechanisms have included the following:

Metal or plastic clasps; the problem with these is that the clasps are separate from the bracelet and easily lost.

Adhesive attachment mechanisms; these generally simply attach the ends of the bracelet to each other. The bracelet fits closely only where the patient happens to be the same size as the bracelet. Schintz solves this problem, as described above, but at the cost of a difficult application process.

The printable plastic bracelets described in U.S. Ser. No. 10/857,214 are easy to apply, fit precisely, are durable, and can be printed with standard office printers. The present patent application discloses a variation on the printable plastic bracelets of U.S. Ser. No. 10/857,214 which may be applied and printed on in exactly the same way as the bracelets of U.S. Ser. No. 10/857,214, but which have two layers instead of one. One advantage of the two-layered construction is that the bracelet can include removable labels; another is that the layers may have different properties; for example, the layer that is on the outside of the bracelet may be particularly adapted to being printed, while the layer that is on the inside of the bracelet may be particularly adapted to minimize irritation to the wearer's skin.

BRIEF SUMMARY OF THE INVENTION

In one aspect, the invention is a band that is formable into a loop. The band has a head end and a tail and includes a first layer that, when the band is formed into the loop, is the outside of the loop, and a second layer that, when the band is formed into the loop, is the inside of the loop. The first and second layers are bonded to each other and there are a first portion of the band at the head end in which the first layer is bonded to the second layer and the second layer is a release liner with regard to the contact adhesive. The construction of the band permits the band to be formed into a loop by removing the second layer from the first portion and attaching the exposed contact adhesive to the first layer in the tail.

In another aspect, the invention is a business form for the band of the first aspect. The business form includes the band's first and second layers and the second layer has a first portion and a second portion which is separate from the first portion. The first portion is bonded to the head end of the band by a contact adhesive and is a release layer with respect to the contact adhesive. The second portion is bonded unreleasably to at least part of the first layer in the tail of the band. The band is die cut in the business form such that only the first layer is cut for the head end and both layers are cut for the tail.

In both aspects, the layers may be made up of materials having different properties; for example, the first layer may be printable and the second layer may be chosen to reduce skin irritation. The strengths of the first and second layers are such that when the band is made into the loop, the loop has the required strength. For example, if the second layer is chosen to reduce-skin irritation, the first layer will by itself have the required strength.

In a particular embodiment, the first layer includes a removable portion in the tail, and the second layer is releasably bonded to the removable portion. The first layer is printable and the releasable bond of the removable portion is a contact adhesive with regard to which the second layer is a release layer. The first layer includes printed identification information in its non-removable portion and the removable portion includes printed further information associated with the identification information.

Other objects and advantages of the invention will be apparent to those skilled in the arts to which the invention pertains upon perusal of the following Detailed Description and drawing, wherein:

DETAILED DESCRIPTION OF THE INVENTION

Identification Bracelets

Figure 1:
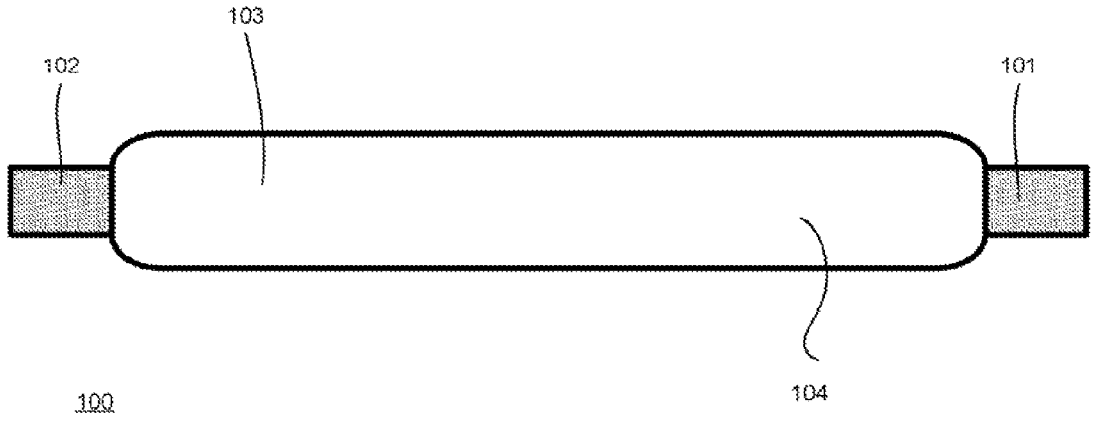
FIG. 1 Prior art
FIG. 1 is a top view of a prior art identification bracelet.
Figure 2:
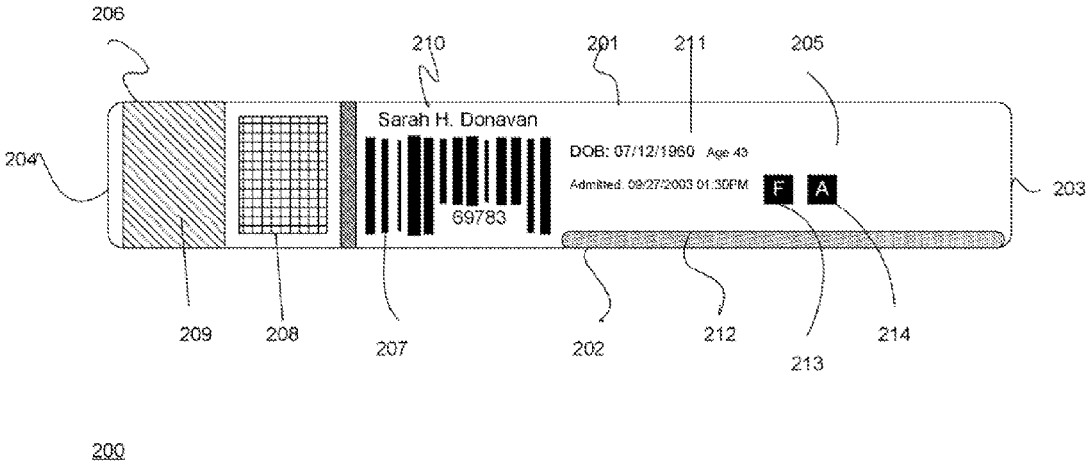
FIG. 2 is a top view of a strip of material used to, produce an identification bracelet illustrating the placement of printed indicia on the bracelet.

Referring first to FIG. 2, the print side of an identification bracelet 200 made according to the current invention is shown. The bracelet includes two long edges 201 and 202. The bracelet 200 can be of various lengths and thicknesses, allowing for bracelets that will fit all ages and sizes of subjects, and that have the resistance to tearing and stretching required for a particular type of subjects. The bracelet 200 is formed by looping the short edge 204 over the short edge 203 and pressing an adhesive area opposite 206 on the non-print side of the bracelet to the outer body 205 of the print side of the bracelet. The adhesive area opposite 206 on the non-print side of the bracelet has a width equal to the width of the bracelet.

An advantage of having adhesive at only one end of the bracelet is that short bracelets can be combined to make long bracelets simply by attaching the adhesive end of a first short bracelet to the printed side of the non-adhesive end of a second short bracelet and then attaching the adhesive end of the second short bracelet to the printed side of the non-adhesive end of the first short bracelet. Of course, any number of bracelets may be hooked end to end by this technique.

In a preferred embodiment the material of the identification bracelet 200 is itself impervious to environmental degradation and may be printed using a standard office ink jet printer. The printing has high resolution and is impervious to environment degradation as well. The material is the oriented and cross-laminated polyethylene film commercially known as VALERON®. With Valeron, the relationship between material thickness and tensile strength is as follows:

| Thickness in Inches | Tensile Strength (ASTM D-882 |
|---|---|
| .0025 | 21 LbF |
| .003 | 22 |
| .004 | 24 |

-continued

| Thickness in Inches | Tensile Strength (ASTM D-882 |
|---|---|
| .0065 | 42 |
| .0086 | 47 |
| .0125 | 57 |

An advantage of Valeron is that its relatively great thickness when compared with plastic materials such as the ones used in Schintz' bracelets gives it handling properties that are closer to those of paper than to those of thin plastic sheets. These handling properties in turn make bracelets made of Valeron easier to apply than those made of thin plastic sheets.

In an alternate embodiment, the material of which the bracelets are made is impervious to environmental degradation and may be printed using a standard office laser printer. The printing has the high resolution and imperviousness to environmental degradation characteristic of laser printing generally. The material is oriented polyethylene film with a symmetrical toner receptive coating. One commercially available form of this material is Solution II™ Xerographic Laser Film and is manufactured by ICI Imagedata.

The resolution of the printing in both embodiments permits machine readable bar codes 207, thumbnail images 208, institutional logos 209, patient name 210, admitting and age information 211, color codes 212, patient sex 213, and allergy information 214, as well as any other kind of information which can be fit onto the bracelet.

Figure 3:
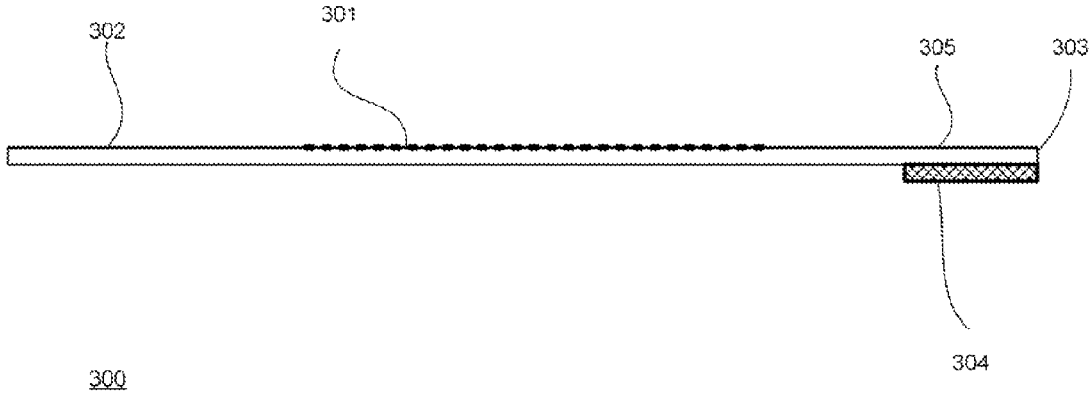
FIG. 3 is a side view of FIG. 1 highlighting the placement of adhesive on a single end.

Referring next to FIG. 3, a side view of an identification bracelet 300 is shown. The strip of material contains a first surface with an area 301 for printing on. On a single end of the strip of material a contact adhesive 303 on the second surface is shown. The identification bracelet is formed by looping the end 303 over the contact area 302 until the bracelet fits properly then pressing the area 305 such that the contact adhesive 304 creates an adhesive bond on the contact area 302.

Figure 4:
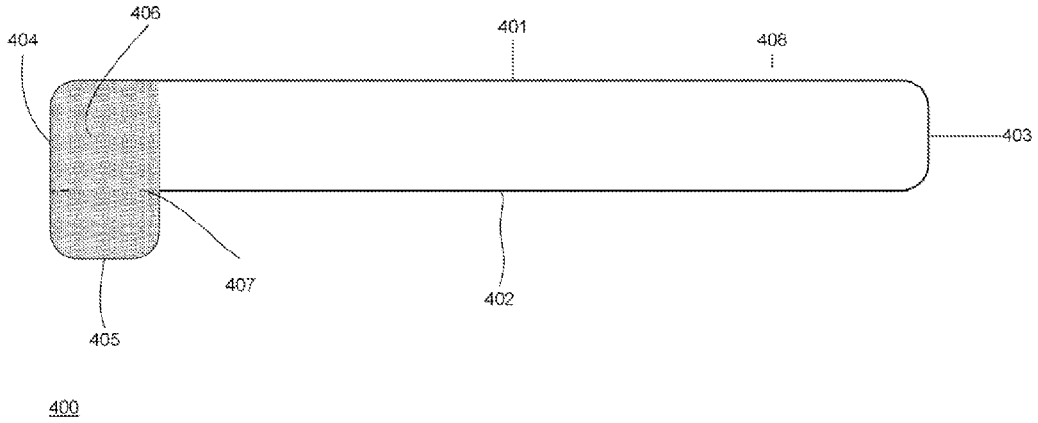
FIG. 4 is a bottom view of a strip of material used to produce an identification bracelet with a single tab placed on the long side of the strip of material.

Referring next to FIG. 4, a non-printed side of an identification bracelet 400 is shown. The strip of material includes two edges 401 and 402 which are the long edge of the strip used to form an identification bracelet. On a single end of the strip, a tab 405 projects from the long edge 402. The second surface of the strip of material contains a contact adhesive 406 which is dispersed along the lateral tab 405 and the end of the strip of material 404. The identification bracelet is formed by looping the end 404 over the first surface 408 causing the contact adhesive 406 to be pressed against the first surface opposite 408. The lateral tab 405 is then folded over at the line 407 such that the adhesive on the second surface comes in contact with the second surface 408.

Figure 5:
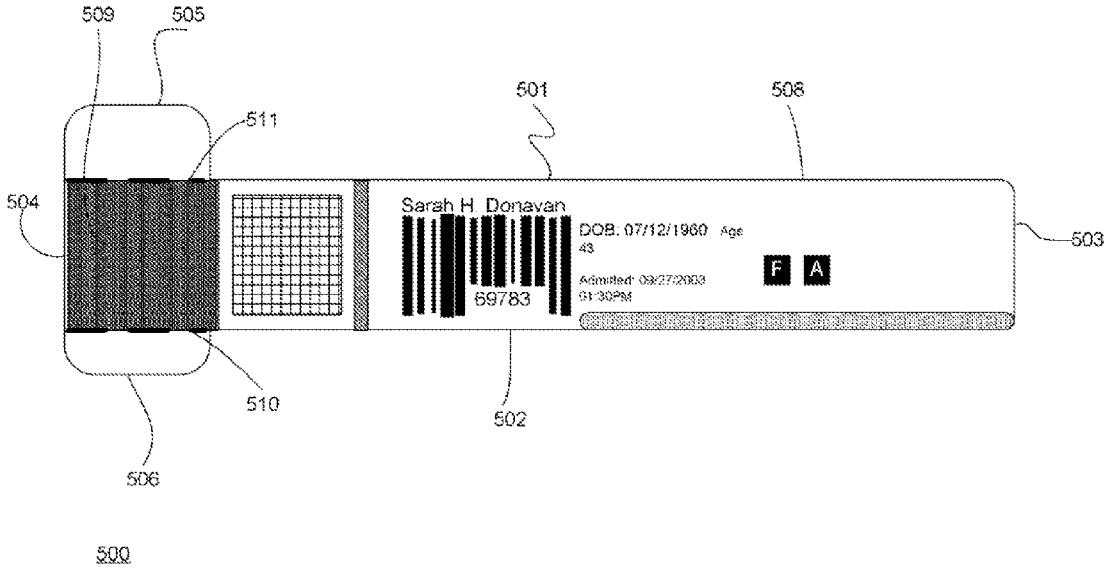
FIG. 5 is a top view of a strip of material used to produce an identification bracelet with a pair of tabs opposite each other on the long side of the strip of material.

Referring next to FIG. 5, identification bracelet 500 is harder for a wearer to remove than the identification bands of FIGS. 2 and 4. The strip of material includes two edges 501 and 502 which are the long edge of the strip used to form an identification bracelet. In a preferred embodiment the strip is wider than the strips of FIG. 2 and FIG. 4. The wider strip makes the identification bracelet stronger and thus more resistant to stretching. On a single end of the strip two tabs 505 and 506 project laterally from the long edges 501 and 503 respectively. The second surface of the strip of material contains a contact adhesive opposite 509 which is dispersed along the lateral tabs 505 and 506 and the end of the strip of material 505. In a preferred embodiment, the contact adhesive is resistant to softening at body temperature. The identification bracelet is formed by looping the end 504 over the first surface 508, causing the contact adhesive opposite 509 to be pressed against the first surface 508. The lateral tab 505 is then folded over at the line 511 such that the adhesive on the second surface comes in contact with the second surface opposite 508. The lateral tab 506 is then folded over at the line 510 such that the adhesive on the second surface comes in contact with the second surface opposite 508. The lateral tabs 505 and 506 when folded over meet but do not overlap. The two tabs anchor the end of the bracelet so that it cannot be pried up by the wearer. In a version of bracelet 500 used for adult wearers who may attempt to remove the bracelet, 500 the width of the bracelet 500 is 1 inch. The thickness of the identification bracelet 500 is a range of approximately 0.010 inches to approximately 0.020 inches.

Figure 6:
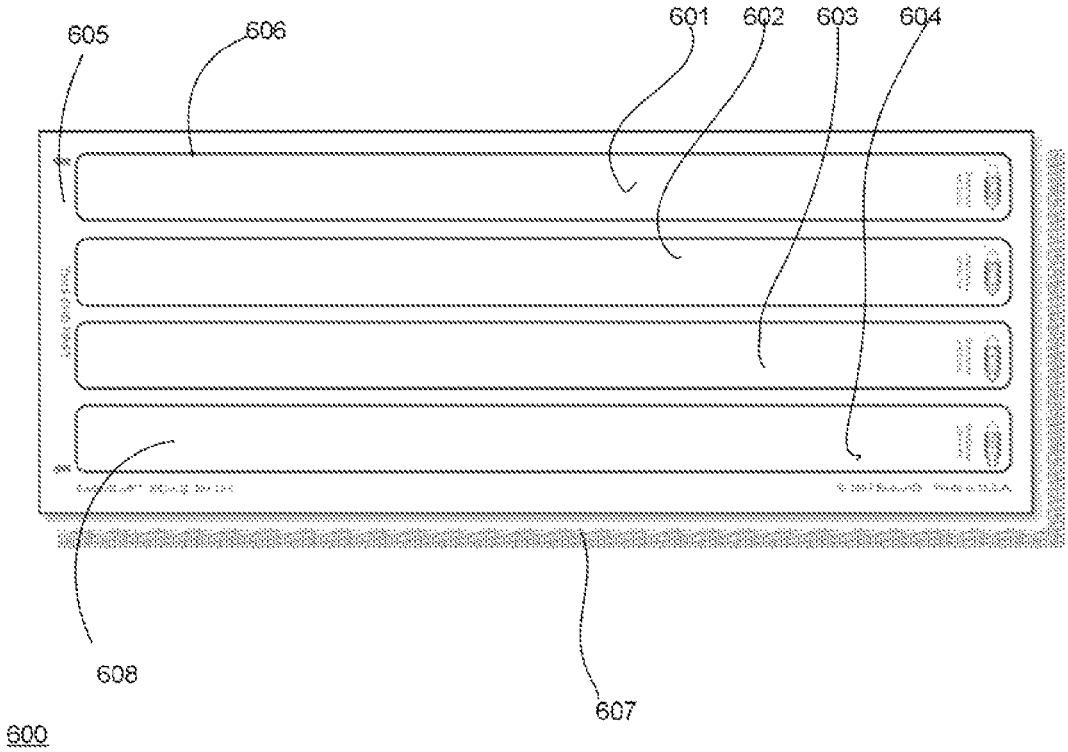
FIG. 6 is a top view of a business form containing an array of bracelets.

Referring next to FIG. 6, a business form 600 with multiple plies and an array of identification bracelets is shown. The top ply 605 of the business form 600 is constructed with a strip of material from which bracelets are made. The identification bracelets 601-604 can be removed from the form 600 along a preferential line of weakness 606. Interposed between the top ply 605 and the liner ply 607 is a contact adhesive on a single end 608 of each identification bracelet 601-604. The liner ply 607 contains a release coating to allow the removal of the identification bracelets 601-604 with the adhesive end 608. The business form 600 is inserted into the input tray of a standard office printer or manually fed into a standard office printer for the purposes of printing indicia on the surface of the identification bracelets 601-604.

Figure 7:
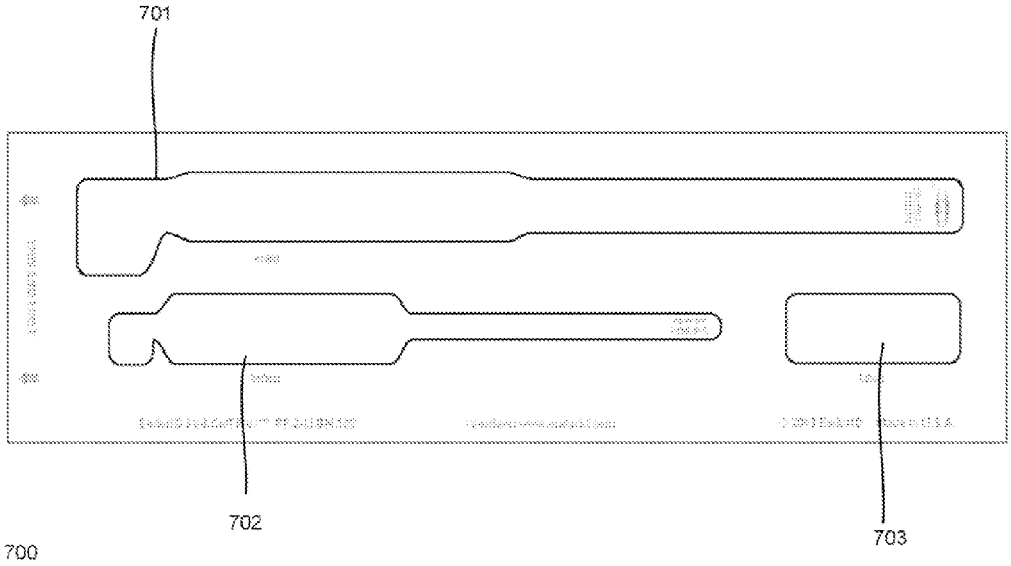
FIG. 7 is a top view of a business form containing an array of bracelets and labels.

Referring next to FIG. 7, a business form 700 with multiple identification bracelets and a label are disclosed. The business form 700 contains an identification bracelet 701 suitable for wearing by a larger child. The form further contains a second identification bracelet 702 suitable for wearing by an infant or smaller pediatric patient. The form 700 also contains a label 703 suitable for labeling an item related to the patient such as the patient's file or medicine intended for the patient.

Figure 8:
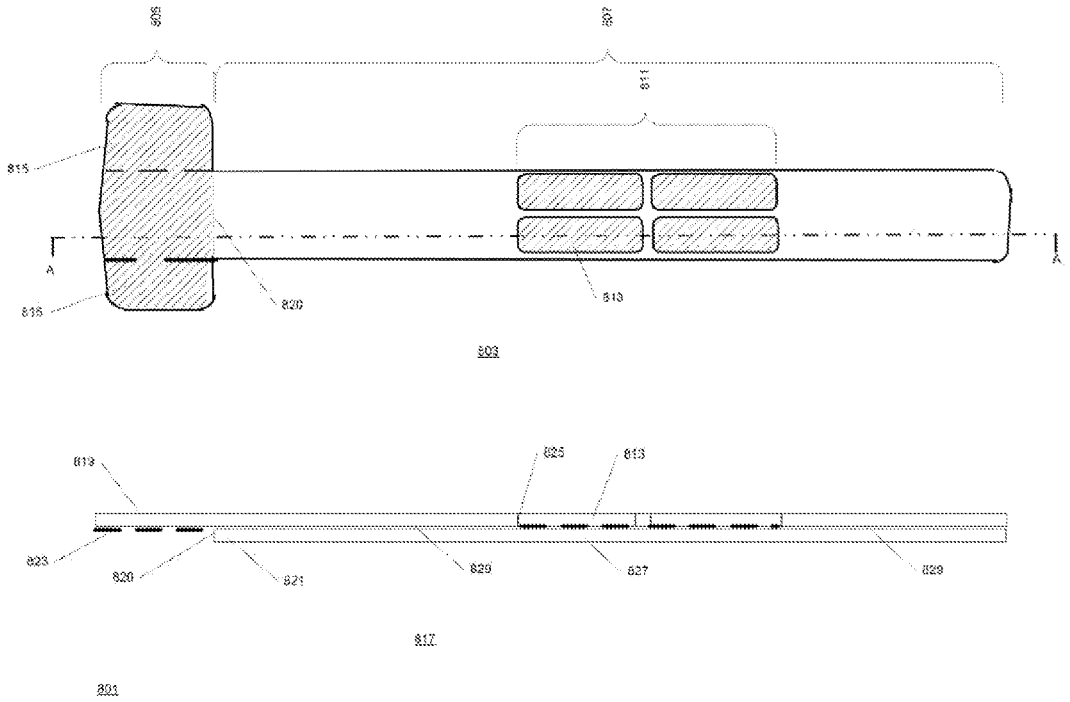
FIG. 8 shows the two-layered bracelet.
Figure 9:
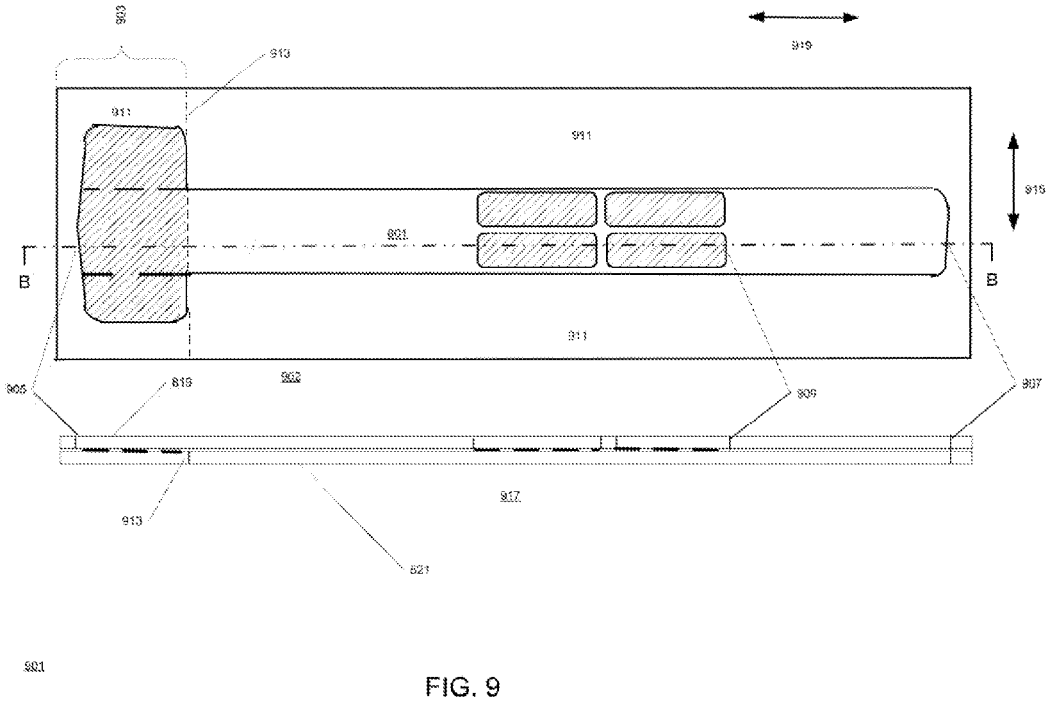
FIG. 9 shows a business form which contains the two-layered bracelet.

Two-Layered Bracelets: FIGS. 8 and 9

FIG. 8 shows a presently-preferred embodiment 801 of a two-layered version of the identification bracelet of the parent. The Figure shows two-layered identification bracelet 801 as it appears after it has been printed and removed from the business form. Identification bracelet 801 can be printed in the same fashion as the identification bracelet of the parent and is made into a bracelet in the same fashion: portion 805 of the bracelet (termed the "head end" in the following) has contact adhesive on its underside and the bracelet is wrapped around the patient's extremity and the contact adhesive is attached to the surface of portion 807 of the bracelet 807 (termed the "tail in the following) at a point which results in a bracelet that fits snugly on the patient's extremity. As explained in the parent, head end 805 may have one or more tabs 815 which are wrapped around the tail 807 of the bracelet and secured to the underside of the bracelet to make the bracelet more difficult to remove. In the following, bracelet 801 is at times termed a "band" before it is made into a bracelet.

That band 801 has two layers is apparent at 817, which shows cross section AA of band 803. There are two layers: 819, which forms the outside of the bracelet when the bracelet is made, and 821, which forms the inside. In a preferred embodiment, layer 819 is 0.025 polyester which has been treated with a coating to make it printable by a laser printer. Layer 821 is also made of 0.025 polyester. Layers 819 and 821 are bonded together along line 829. In a preferred embodiment, the bonding is done using an adhesive that is adapted to the materials of the layers. In a preferred embodiment, the portion of layer 819 which includes head end 805 extends beyond layer 821, as shown at 820 in both view 803 and view 817. The underside of the portion of layer 819 which extends beyond layer 821 has contact adhesive 823, which permits attachment of head end 805 to tail end 807.

In a presently-preferred embodiment, the two-layered construction of band 801 permits the inclusion of removable labels 813 in layer 819. Four of the removable labels are shown at 811. As may be seen from cross section 819 and more particularly at 825, the removable labels have been "kiss cut", i.e., die cut so that layer 819 is cut but not layer 821. Further, the labels have contact cement 827 on their undersides and layer 821 has a UV release patch in the portion of that layer which is beneath labels 813 so that it serves as a release liner for the contact cement. Consequently, labels 813 may be removed individually from the bracelet.

In the preferred embodiment, each of layers 821 and 819 has the strength required for the bracelet by itself, and consequently, the labels can be removed from layer 819 without affecting the integrity of the bracelet. The contact cement on the labels permits the labels to be attached to other objects. In one application, bracelet 801 is used to identify a wearer of the bracelet who is, participant in an activity. The bracelet is printed with identification information for the wearer on the portion of tail 807 closest to head end 805 and the labels are also printed with such information. The labels can then be attached to objects belonging to the wearer in order to identify them as belonging to the wearer.

FIG. 9 shows a presently-preferred embodiment of a business form 901 for band 801. Two views are presented in the figure: 902, which shows the form as seen from the side of the form that receives the printed information, and 917, which is a cross section of the form as seen at B-B. The form has the same two layers 819 and 821 as the band. When band 801 is on the business form, a laser printer may be used to print information on layer 819. Other types of printers or marking devices may be used in other embodiments, depending on the properties of layer 819. In a preferred embodiment, the web from which the business form is made moves through the machinery that makes the business form in either of the directions 915; when printed, the business form moves through the printer in either of the directions shown by line 919.

In the areas of business form 901 which are not part of band 801, layers 819 and 821 are held together by light adhesive which permits separation of the layers, as indicated by reference numbers 911. Further, as shown at 903, in the portion of business form that contains head end 805 of band 801, layer 821 is split along line 913. The portion of layer 821 that belongs to area 903 and is underneath head end 805 of the band has a release patch so that contact cement 823 on the bottom side of layer 819 does not stick to that portion of layer 821. The split and a combination of kiss cutting through a single layer and die cutting through both layers permits band 801 to be removed from form 901 and contact cement 823 on head end 805 to be exposed by removing the portion of layer 821 that belongs to area 923 from contact cement 823. In more detail, kiss cutting of layer 819 is employed around head end 805 as shown at 905 and around each label 813, as shown at 909, and die cutting through both layer 819 and 821 is employed around tail end 807, as shown at 907. When the person applying the bracelet to its wearer separates tail 807 from form 901, head end 911 and split portion 903 of layer 821 accompany tail 807. The kiss cutting of layer 819 around head end 805 and the release patch on split portion 903 under head end 805 permit the person applying the bracelet to separate split portion 903 from head end 805 and thereby to expose adhesive 823 for attachment of head end 805 to layer 819 at a point in tail 807 such that the bracelet properly fits the bracelet's wearer. Labels 813 may be removed from tail end 807 while the band is still attached to form 901, after the band has been removed from form 901 but before it is applied to the recipient, or while the wearer is wearing the bracelet.

Two-layer bracelets like bracelet 801 may be used in any situation in which layers with different properties are useful. In bracelet 801, layer 819 has two properties which distinguish it from layer 821: it is printable by a laser printer and it includes removable components. Other situations where layers with different properties may be desirable include ones in which layer 819 may cause skin irritation, in which case, layer 821 may be made of a material which does not cause skin irritation, ones in which the material of layer 819 is too weak at some point in tail 807 to provide the necessary strength to bracelet 801, ones in which layer 819 has a radically different appearance from layer 821, for example, is made of a strongly reflective material, or ones in which layer 819 contains electronic or electromagnetic components which identify the user or make it possible to detect the user's presence or location. Examples here include bracelets which set off an alarm when the wearer passes a particular point or bracelets which broadcast the wearer's identification and/or location.

The relative strengths of the layers will depend upon the differences between them; for example, in the embodiment shown at in FIGS. 8 and 9, each of layers 819 and layer 821 must have by itself the strength needed for the bracelet. Layer 819 must have that strength because head end 805 has only layer 819 and it is head end 805 which attaches to tail 807 when the bracelet is formed. Layer 821 must have that strength because layer 819 is weakened in tail 807 by the presence of removable labels 813. By contrast, if layer 819 has nothing on it which affects its strength and layer 821's purpose is simply to reduce skin irritation, it is enough if only layer 819 has the strength needed for the bracelet. In some embodiments, the strengths of the layers may vary at different points in the bracelets. For example, in the embodiment of FIG. 8, layer 819 may be particularly strong at head end 805 and the adjacent portion of tail 807 and layer 821 may be particularly strong in the area underneath and adjacent to labels 813. What is important, of course, is that the layers give the bracelet the strength it needs when it is being worn.

With bracelets that have removable labels, the labels may be used as described above to label objects belonging to the bracelet's wearer. The labels may also include electronic or electromagnetic components which identify the user and/or make it possible to locate the objects to which the labels have been applied. Another use of the removable labels is as admission tickets. For example, when a guest is admitted to a theme park that contains many attractions, the guest may specify the attractions he or she is interested in and pay for them on admission to the park. At that point, a bracelet with removable labels can be printed for the guest, with a label on the bracelet for each attraction the guest is interested in. To gain admission to an attraction, the guest must remove the label for the attraction from the bracelet and present the label to the ticket taker. In this application, of course, there would be no need for the label to have more adhesive than is required to keep it attached to layer 821.

CONCLUSION

The foregoing Detailed Description has disclosed to those skilled in the relevant technologies how to make and use bracelets which are formed by attaching a head end of the bracelet that includes adhesive to a tail of the bracelet and which have layers with different properties. In a preferred embodiment, the bracelet is an identification bracelet and one of the layers is printable by a laser printer and includes removable labels. The properties of the layers, the materials with which the bracelet is constructed, the manner of its construction, and its appearance will of course all depend upon the purpose for which the bracelet is being used. Similarly, details of the business forms that contain the bracelets will depend on the properties of the layers, the manner in which the bracelet is constructed, and the technology used to print the bracelet. Finally, the bands disclosed herein may be used not only for bracelets, but in any situation where a band that is formable into a loop may be desired, for example, to identify luggage. For these reasons, the Detailed Description is to be regarded as being in all respects exemplary and not restrictive, and the breadth of the invention disclosed herein is to be determined not from the Detailed Description, but rather from the claims as interpreted with the full breadth permitted by the patent laws.

The invention claimed is:

1. A business form for a band that is formable into a loop and has a head end and a tail, the business form comprising:

a first layer that when the business form's band is formed into the loop is the outside of the loop; and a second layer that when the business form's band is formed into the loop is the inside of the loop, the second layer having a first portion and a second portion which is separate from the first portion, the first portion being bonded to the head end of the band by a contact adhesive and being a release layer with respect to the contact adhesive and the second portion being bonded unreleasably to at least part of the first layer in the tail of the band and the band being die cut in the business form such that only the first layer is cut for the head end and both layers are cut for the tail.

2. The business form set forth in claim 1 wherein:

the first layer is made of a first material; and the second layer is made of a second material.

3. The business form set forth in claim 2 wherein:

the first material has a first property.

4. The business form set forth in claim 3 wherein:

the second layer has a second property that is different from the first property.

5. The business form set forth in claim 1 wherein:

the strengths of the layers when the band is made into the loop are such that the loop has a required strength.

6. The business form set forth in claim 3 wherein:

the first property is that the first material is printable by a printing device.

7. The business form set forth in claim 4 wherein:

the second property is that the second layer is chosen to reduce skin irritation.

8. The business form set forth in claim 1 wherein:

the strengths of the layers when the band is made into the loop are such that the loop has a required strength.

9. The business form set forth in claim 8 wherein:

in the head end, the first layer has by itself the required strength for the loop; and in the tail, the second layer has by itself the required strength for the loop.

10. The business form set forth in claim 8 wherein:

the first layer has by itself the required strength for the loop.

11. The business form set forth in claim 1 wherein:

in the tail, the first layer includes a second portion that is separable from the remainder of the first layer and the second layer includes a third portion under the second portion that is a release liner with regard to the second portion, whereby the second portion is separable from the remainder of the first layer.

12. The business form set forth in claim 11 wherein:

the band has a first printed area which is not in the second portion and a second printed area which is in the second portion.

13. The business form set forth in claim 12 wherein:

the first printed area contains identification information for an entity to which the loop made from the band is attached; and the second printed area contains further information that is associated with the identification information.

14. The business form set forth in claim 11 wherein:

there is a plurality of the second portions.

* * * * *